US010176915B2

(12) United States Patent
Durand et al.

(10) Patent No.: US 10,176,915 B2
(45) Date of Patent: Jan. 8, 2019

(54) BISTABLE LINEAR ELECTROMAGNET

(71) Applicant: SAFRAN LANDING SYSTEMS, Velizy Villacoublay (FR)

(72) Inventors: Guillaume Durand, Velizy Villacoublay (FR); Steve Coustenoble, Velizy Villacoublay (FR); Laurent Monsaint, Velizy Villacoublay (FR)

(73) Assignee: SAFRAN LANDING SYSTEMS, Velizy Villacoublay (FR)

( * ) Notice: Subject to any disclaimer, the term of this patent is extended or adjusted under 35 U.S.C. 154(b) by 21 days.

(21) Appl. No.: 15/638,512

(22) Filed: Jun. 30, 2017

(65) Prior Publication Data

US 2018/0005744 A1 Jan. 4, 2018

(30) Foreign Application Priority Data

Jul. 1, 2016 (FR) ..... 16 56314

(51) Int. Cl.

| | |
|---|---|
| ***H01F 7/16*** | (2006.01) |
| ***H01F 7/18*** | (2006.01) |
| ***H01F 7/122*** | (2006.01) |
| ***H01F 7/121*** | (2006.01) |
| ***H01F 7/17*** | (2006.01) |

(52) U.S. Cl.

CPC ..... *H01F 7/1872* (2013.01); *H01F 7/121* (2013.01); *H01F 7/122* (2013.01); *H01F 7/16* (2013.01); *H01F 7/1638* (2013.01); *H01F 7/1646* (2013.01); *H01F 7/17* (2013.01); *H01F 2007/1669* (2013.01); *H01F 2007/1684* (2013.01); *H01F 2007/1692* (2013.01); *H01F 2007/185* (2013.01)

(58) Field of Classification Search

CPC ..... H01F 7/122; H01F 7/1638; H01F 7/1646; H01F 2007/1684; H01F 2007/1692; H01F 2007/185

See application file for complete search history.

(56) References Cited

U.S. PATENT DOCUMENTS

2017/0256348 A1* 9/2017 Thode ..... H01F 7/122

FOREIGN PATENT DOCUMENTS

| | | |
|---|---|---|
| DK | 297 03 587 U1 | 6/1998 |
| DK | 10 2009 042 777 A1 | 4/2011 |
| EP | 2 587 496 A1 | 5/2013 |
| EP | 2 944 521 A1 | 11/2015 |
| FR | 2 940 500 A1 | 6/2010 |

OTHER PUBLICATIONS

French Preliminary Search report FR 1656314 dated Mar. 3, 3017.

* cited by examiner

*Primary Examiner* — Ramon M Barrera
(74) *Attorney, Agent, or Firm* — Sughrue Mion, PLLC

(57) ABSTRACT

A bistable linear electromagnet comprising a first housing (10) and a second housing (11) in alignment, a movable armature (18) comprising a rod (19) and a shuttle (20) that is slidably mounted, and a first coil (13) positioned in the first housing and a second coil (15) positioned in the second housing. A cavity (25) is made in a measurement wall (4) of one of the housings, and the electromagnet comprises a magnetic field sensor (26) positioned in the cavity and designed to measure a magnetic flux existing in a magnetic path formed by the walls of said housing and by the shuttle, in order to detect whether the shuttle has moved towards or away from the abutment wall of said first or second housing.

7 Claims, 2 Drawing Sheets

BISTABLE LINEAR ELECTROMAGNET

The invention relates to the field of monitoring the position of the rod of a bistable linear electromagnet.

BACKGROUND OF THE INVENTION

A braking architecture for the wheel of an aircraft is known that comprises a brake provided with at least one hydraulic actuator for braking the wheel, a source of pressure suitable for delivering a hydraulic fluid at high pressure, a hydraulic braking circuit for normal braking, and a hydraulic circuit for parking.

The parking hydraulic circuit conventionally comprises a parking valve having an outlet port adapted to be selectively connected either to the source of pressure, or to a return circuit at low pressure relative to said high pressure.

The parking valve is conventionally operated by a linear electromagnet including a rod sliding between an extended position and a retracted position. The position of the rod is generally monitored by means of a pressure sensor that measures the pressure in the parking hydraulic circuit. The pressure sensor is bulky, heavy, and expensive. It has been envisaged to monitor the position of the rod by incorporating a position sensor directly on the rod. However, the presence of hydraulic fluid in the environment of the rod prevents such incorporation. In addition, the short stroke of the rod would probably not allow the position of the rod to be detected accurately in the most unfavorable configurations (thermal drift, dimensional chains, expansion, etc.).

OBJECT OF THE INVENTION

The object of the invention is to provide monitoring of the position of the rod of an electromagnet that does not present the above-mentioned drawbacks.

SUMMARY OF THE INVENTION

With a view to satisfying this object, there is provided a bistable linear electromagnet comprising a hollow body having walls defining a first housing and a second housing aligned along an axis X, a movable armature comprising a rod linked to a shuttle mounted to slide in the hollow body along the axis X between a first end position in which it comes into abutment against an abutment wall of the first housing and a second end position in which it comes into abutment against an abutment wall of the second housing, and a first coil positioned in the first housing and a second coil positioned in the second housing, in such a manner that the shuttle slides towards the first end position when a first current flows in the first coil and in the second coil, and in such a manner that the shuttle slides towards the second end position when a second current flows in the first coil and in the second coil. A cavity is made in a measurement wall of one of the first and second housings, and the electromagnet includes a magnetic field sensor positioned in the cavity and designed for measuring a magnetic flux existing in a magnetic path formed by the walls of said first or second housing and by the shuttle, in order to detect whether the shuttle has moved towards or away from the abutment wall of said first or second housing.

The position of the rod of the electromagnet of the invention is thus monitored by the magnetic field sensor that is incorporated in the measurement wall of the hollow body of the electromagnet. This monitoring is therefore performed by means that are compact, lightweight, and inexpensive. The magnetic field sensor, positioned in the cavity made in the measurement wall is positioned in simple manner in an environment that is free from hydraulic fluid. Finally, monitoring of the position of the rod by measuring the magnetic flux makes this monitoring robust, even in the event of unfavorable mechanical and thermal configurations of the rod.

The invention can be better understood on reading the following description of a particular non-limiting embodiment of the invention.

BRIEF DESCRIPTION OF THE DRAWINGS

Reference is made to the accompanying drawings, in which.

DETAILED DESCRIPTION OF THE INVENTION

Figure 1:
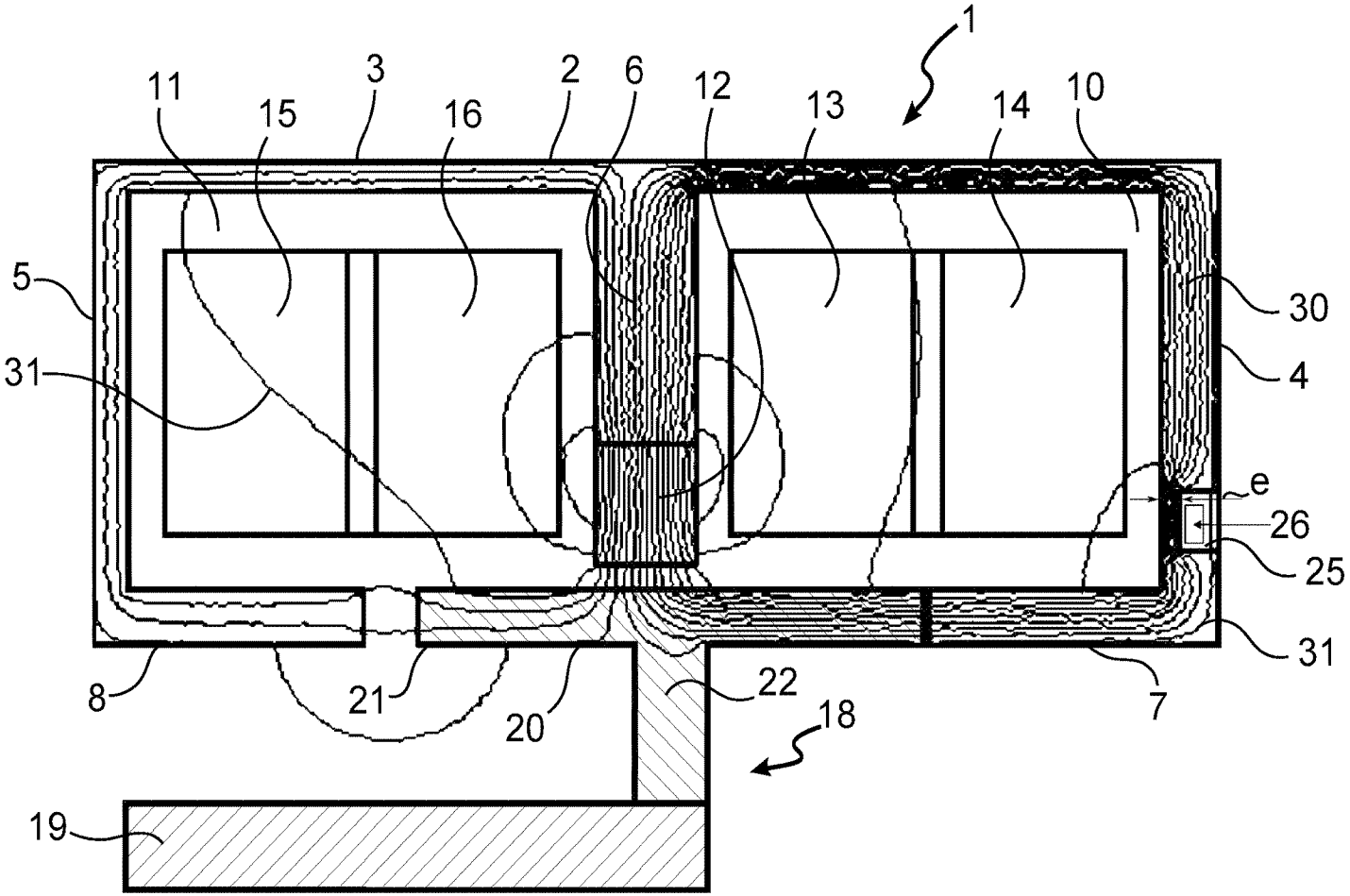
FIG. 1 is a section view of the electromagnet of the invention, in a plane passing through a longitudinal axis of the electromagnet, a rod of the electromagnet being in a retracted position.
Figure 2:
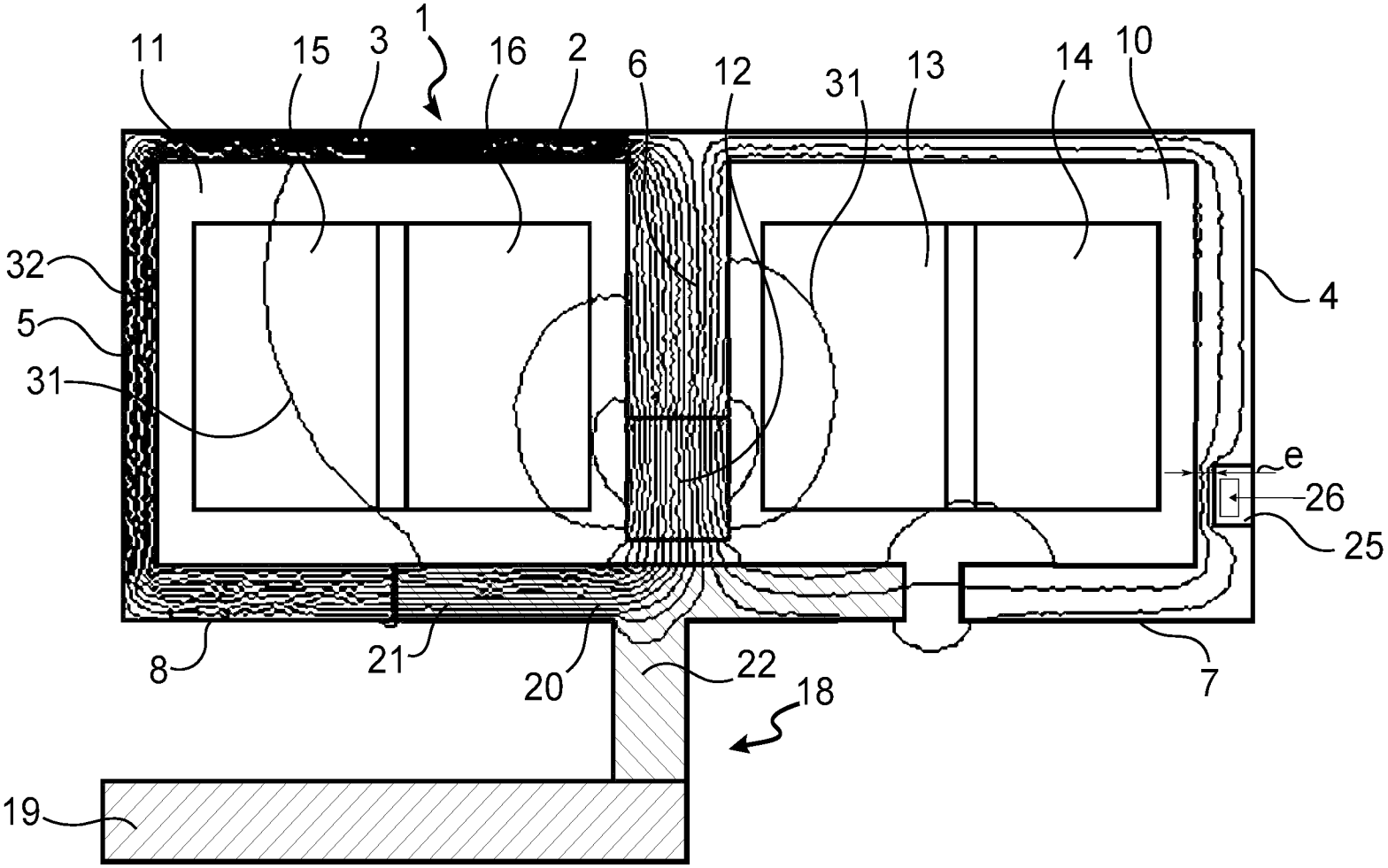
FIG. 2 is a view analogous to that of FIG. 1, wherein the rod of the electromagnet is in an extended position.

With reference to FIGS. 1 and 2, the electromagnet 1 of the invention is a linear electromagnet that comprises a hollow body 2 presenting a cylindrical outer shape of circular section and having as its longitudinal axis an axis X.

The hollow body 2 comprises a plurality of walls, among which a main wall 3 presenting a cylindrical surface having as its longitudinal axis the axis X, a first end wall 4 forming a first face of the hollow body 2, a second end wall 5 forming a second face of the hollow body 2, a central wall 6 parallel to the first and second end walls 4, 5 and equidistant from the first and second end walls 4, 5, and a first abutment wall 7 and a second abutment wall 8. The first abutment wall 7, that presents an annular shape having as its longitudinal axis the axis X, extends from the first end wall 4 towards the inside of the hollow body 2. The second abutment wall 8, that presents an annular shape having as its axis the axis X, extends from the second end wall 5 towards the inside of the hollow body 2.

The main wall 3, the first end wall 4, the first abutment wall 7 and the central wall 6 define a first housing 10 in the hollow body 2.

The main wall 3, the second end wall 5, the second abutment wall 8 and the central wall 6 define a second housing 11 in the hollow body 2.

In this embodiment, the hollow body 2 (and therefore the set of above-mentioned walls) is made from martensitic stainless steel. Specifically, the martensitic stainless steel used is a stainless steel of the X30Cr13 type.

A permanent magnet 12, of annular shape, extends from the central wall 6 towards the axis X. The central wall 6 and the permanent magnet 12 separate the first and second housings 10, 11. In this embodiment, the permanent magnet 12 is a neodymium magnet made of $SmCo_5$.

The first housing 10 includes a first main coil 13 and a first auxiliary coil 14. The second housing 11 includes a second main coil 15 and a second auxiliary coil 16. The first and second main coils 13, 15 are connected in series. The first auxiliary coil 14 and the second auxiliary coil 16 are connected in series.

The electromagnet 1 further comprises a movable armature 18 comprising a rod 19 and a shuttle 20. The longitudinal axis of the rod 19 is an axis X'. The shuttle 20 comprises a main portion 21 and a connection portion 22. The main portion 21 of the shuttle 20 presents a cylindrical outer shape of circular section and has as its longitudinal axis the axis X'. The connection portion 22 is a wall perpendicular to the axis X' and situated in the center of the main portion 21. When the movable armature 18 is mounted in the hollow body 2, the axis X' coincides with the axis X.

The rod 19 of the movable armature 18 is made of aluminum. In this embodiment, the shuttle 20 is made of martensitic stainless steel. Specifically, the martensitic stainless steel used is a stainless steel of the X30Cr13 type. The rod 19 is fastened to the shuttle 20 in such a manner as to extend coaxially therein.

The electromagnet 1 operates as follows. When a first control voltage is applied, a first current flows in a first direction in the first main coil 13 and in the second main coil 15, a first magnetic field is generated, under the effect of which the shuttle 20 slides in the hollow body 2 along the axis X and moves towards the first abutment wall 7 of the first housing 10 until it reaches a first end position in which the shuttle 20 comes into abutment against the first abutment wall 7 of the first housing 10. The rod 19 is thus in a retracted position. When the first control current is no longer applied and the first current no longer flows, the shuttle 20 is held in the first end position by the effect of a magnetic field generated by the permanent magnet 12. The rod 19 is therefore held in the retracted position (situation shown in FIG. 1).

When a second control voltage is applied, a second current flows in a second direction opposite the first direction in the first main coil 13 and in the second main coil 15, a second magnetic field is generated, under the effect of which the shuttle 20 slides in the hollow body 2 along the axis X and moves towards the second abutment wall 8 of the second housing 11 until it reaches a second end position in which the shuttle 20 comes into abutment against the second abutment wall 8 of the second housing 11. The rod 19 is then in an extended position. When the second control voltage is no longer applied and the second current no longer flows, the shuttle 20 is held in the second end position by the effect of a magnetic field generated by the permanent magnet. The rod 19 is therefore held in the extended position (situation shown in FIG. 2).

The electromagnet 1 is therefore a bistable linear electromagnet.

The first and second auxiliary coils 14, 16 are arranged in the same manner and play exactly the same role as the first and second main coils 13, 15. The first and second auxiliary coils 14, 16 are used only when a fault (e.g. a short-circuit or an open circuit) appears on the first main coil 13 and/or on the second main coil 15. The magnetic circuit of the electromagnet 1 is therefore redundant.

It should be observed that the hollow body 2 of the electromagnet 1 includes a measurement wall, which is specifically the first end wall 4. The first end wall 4 includes a cavity 25 in the form of a groove opening out to the outside of the hollow body 2. The cavity does not open out to the inside of the cavity of the hollow body 2. The thickness e of the first end wall 4, at the cavity 25, lies in the range 0.4 millimeters (mm) to 1 mm. In this embodiment, this thickness e is approximately equal to 0.7 mm.

A magnetic field sensor, specifically a Hall-effect sensor 26, is positioned inside the cavity 25. The sensitive portion of the Hall-effect sensor 26 is positioned against the bottom of the cavity 25.

The Hall-effect sensor 26 makes it possible to detect whether the shuttle 20 has moved towards the first abutment wall 7 of the first housing 10 or else towards the second abutment wall 8 of the second housing 11. The Hall-effect sensor 26 therefore makes it possible to detect whether the shuttle 20 is located in the first end position or in the second end position, and therefore whether the rod 19 is located in the retracted position or in the extended position.

When the shuttle has moved towards the first abutment wall 7 of the first housing 10, and, in particular, when the shuttle 20 comes into abutment against the first abutment wall 7 of the first housing 10 (as shown in FIG. 1), a magnetic flux resulting from the magnetic field generated by the first main coil 13 (or by the first auxiliary coil 14 if used) is primarily concentrated in a first magnetic path 30 formed by the walls of the first housing 10. The magnetic flux is symbolized by magnetic field lines 31. It can be seen that the magnetic field lines 31 are particularly concentrated in the first end wall 4 at the cavity 25, and therefore that the magnetic flux there is particularly substantial. The Hall-effect sensor 26 thus detects magnetic field leaks at the bottom of the cavity 25, and measures a relatively substantial magnetic field.

Processor means, connected to the Hall-effect sensor 26 and not shown in the figures, acquire the measurements taken by the Hall-effect sensor 26 and, as a function of the amplitude of the magnetic field measured, they detect that the shuttle 20 has moved towards the first abutment wall 7 of the first housing 10, and, possibly, that the shuttle 20 is in abutment against the first abutment wall 7 of the first housing 10. The processor means thus detect that the rod 19 is therefore located in the retracted position.

On the contrary, when the shuttle 20 has moved away from the first abutment wall 7 of the first housing 10, and, in particular, when the shuttle 20 comes into abutment against the second abutment wall 8 of the second housing 11 (as shown in FIG. 2), the magnetic flux resulting from the magnetic field generated by the second main coil 15 (or by the second auxiliary coil 16 if used) is primarily concentrated in a second magnetic path 32 formed by the walls of the second housing 11. The Hall-effect sensor 26 therefore measures a relatively weak magnetic field.

The processor means acquire the measurements taken by the Hall-effect sensor 26 and, as a function of the amplitude of the magnetic field measured, they detect that the shuttle 20 has moved away from the first abutment wall 7 of the first housing 10, and, possibly, that the shuttle 20 is in abutment against the second abutment wall 8 of the second housing 11. The rod 19 is therefore located in the extended position.

It should be noted that it is possible either to perform a "linear" measurement of the position of the shuttle 20 between the first end position and the second end position, and therefore of the position of the rod 19 between the retracted position and the extended position, or to perform a "binary" measurement, which indicates that the shuttle 20 is located either in the first end position, or in the second end position. The binary measurement is simpler to perform and seems more appropriate since the first end position and the second end position are the only stable positions of the shuttle 20.

The Hall-effect sensor 26 may be a latch type Hall-effect sensor providing binary information, but it could also be a linear Hall probe. For a linear probe, it is possible to perform a binary measurement by defining a threshold above which the magnetic field measured corresponds to the first end position of the shuttle 20, and above which the magnetic field measured corresponds to the second end position of the shuttle 20. The threshold may possibly be adjusted during manufacture of the electromagnet 1, or also during system tests before delivery.

Advantageously, the processor means are positioned on a circuit board or in a computer used for powering the electromagnet 1 (and therefore for generating the control voltages applied at the terminals of the coils). Thus, the cost and bulkiness of monitoring the position of the rod 19 are reduced.

Naturally, the invention is not limited to the embodiment described but covers any variant coming within the ambit of the invention as defined by the claims.

Although it is stated that the magnetic field sensor used is a Hall-effect sensor, it is entirely possible for a different sensor (e.g., a magnetoresistive sensor) to be used.

It is also possible to use a plurality of magnetic field sensors, optionally positioned in a common cavity.

Naturally, the sensor may be incorporated in a measurement wall of the second housing. In addition, the measurement wall, which includes the cavity(ies), may be a wall other than an end wall, e.g. an abutment wall.

The invention claimed is:

1. A bistable linear electromagnet comprising a hollow body (2) with walls defining a first housing (10) and a second housing (11) aligned along an axis X, a movable armature (18) comprising a rod (19) linked to a shuttle (20) mounted to slide in the hollow body (2) along the axis X between a first end position in which the shuttle comes into abutment against a first abutment wall (7) of the first housing (10) and a second end position in which the shuttle comes into abutment against a second abutment wall (8) of the second housing (11), and a first coil (13) positioned in the first housing and a second coil (15) positioned in the second housing, in such a manner that the shuttle slides towards the first end position when a first current flows in the first coil and in the second coil, and in such a manner that the shuttle slides towards the second end position when a second current flows in the first coil and in the second coil, the electromagnet being characterized in that a cavity (25) is made in a measurement wall (4) of one of the first or second housings, and in that the electromagnet includes a magnetic field sensor (26) positioned in the cavity and designed for measuring a magnetic flux existing in a magnetic path formed by the walls of said first or second housing and by the shuttle, in order to detect whether the shuttle has moved towards or away from the abutment wall of said first or second housing.

2. An electromagnet according to claim 1, wherein the first housing (10) and the second housing (11) are separated by a wall (6) of the hollow body (2) and by a permanent magnet (12).

3. An electromagnet according to claim 1, wherein the cavity (25) opens out to the outside of the hollow body.

4. An electromagnet according to claim 3, wherein the measurement wall (4) presents, at the cavity, a thickness lying in the range 0.4 mm to 10 mm.

5. An electromagnet according to claim 1, wherein the hollow body (2) is made of martensitic stainless steel.

6. An electromagnet according to claim 1, wherein the shuttle (20) is made of martensitic stainless steel.

7. An electromagnet according to claim 1, wherein the rod (19) is made of aluminum.

* * * * *